US005220342A

United States Patent [19]

Moriyama

[11] Patent Number: 5,220,342

[45] Date of Patent: Jun. 15, 1993

[54] INK JET RECORDING METHOD

[75] Inventor: Jiro Moriyama, Yokohama, Japan

[73] Assignee: Canon Kabushiki Kaisha, Tokyo, Japan

[21] Appl. No.: 608,631

[22] Filed: Nov. 6, 1990

Related U.S. Application Data

[63] Continuation of Ser. No. 464,698, Jan. 16, 1990, abandoned, which is a continuation of Ser. No. 342,966, Apr. 25, 1989, abandoned.

[30] Foreign Application Priority Data

Apr. 26, 1988 [JP] Japan ..... 63-103596

[51] Int. Cl.[5] ..... B41J 2/21

[52] U.S. Cl. ..... 346/1.1; 346/140 R; 358/75; 400/126

[58] Field of Search ..... 346/1.1, 75, 140; 400/126, 121; 358/75

[56] References Cited

U.S. PATENT DOCUMENTS

| | | | |
|---|---|---|---|
| 4,580,148 | 4/1986 | Domoto | 346/140 |
| 4,631,548 | 12/1986 | Milbrandt | 346/140 X |
| 4,682,216 | 7/1987 | Sasaki | 346/140 X |
| 4,760,408 | 7/1988 | Kanayama | 346/140 |
| 4,774,529 | 9/1988 | Paranjpe | 346/140 |
| 5,020,927 | 6/1991 | Niikawa | 400/121 |

*Primary Examiner*—Joseph W. Hartary

*Attorney, Agent, or Firm*—Fitzpatrick, Cella, Harper & Scinto

[57] ABSTRACT

An ink jet recording method which performs color recording and monochromatic recording while moving relatively a head equipped with nozzles corresponding respectively to 4 colors of cyan, magenta, yellow and black and a recording medium in the main scanning direction and the sub-scanning direction. The main scanning speed during the monochromatic recording is made faster than during the color recording, and the monochromatic recording is performed by recording dots of black and black dots formed by mixing of the three colors of cyan, magenta and yellow alternately on the recording medium.

34 Claims, 5 Drawing Sheets

FIG. 3
PRIOR ART
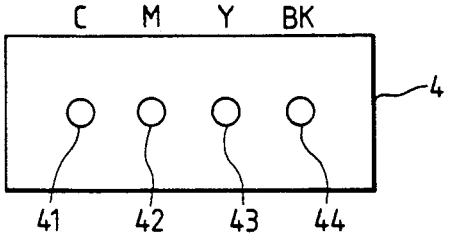
FIG. 4B
PRIOR ART
FIG. 4A
PRIOR ART
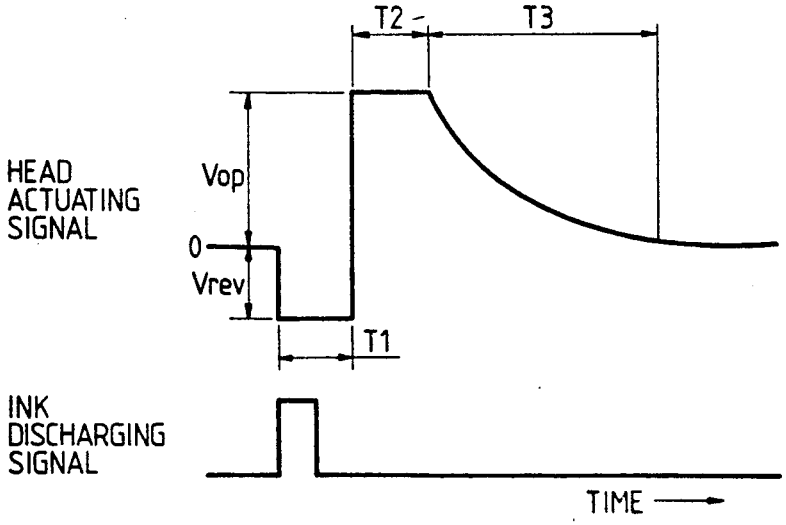

INK JET RECORDING METHOD

This application is a continuation of application Ser. No. 07/464,698 filed Jan. 16, 1990, now abandoned, which is a continuation of application Ser. No. 07/342,966, filed Apr. 25, 1989, now abandoned.

BACKGROUND OF THE INVENTION

1. Field of the Invention

This invention relates to an ink jet recording method for a recording device equipped with a head having a plurality of nozzles corresponding to the respective ink colors of detractive color mixing of color recording to be used for example, in color ink jet recording device.

2. Related Background Art

FIG. 1 is a schematic upper view of an example of an ink jet recording device in general, FIG. 2 is a block diagram showing its control system.

FIG. 1, numeral 1 is a platen which rotates at predetermined steps for sub-scanning during recording with a recording medium (not shown) wound therearound. Numeral 2 is a line feed motor which transmits rotation to the rotational shaft of the platen 1 through a gear 3. 4 is an ink jet recording head (hereinafter called "head") mounted freely slidable on a guide bar (not shown) arranged in parallel to the platen 1, and is provided with a plurality of discharge openings 5 for discharging ink as droplets. Numeral 6 is a belt for moving the head 5 reciprocally in the longitudinal direction of the platen 1. Numerals 7 and 8 are pulleys arranged at the both ends of the belt 6, and numeral 9 a carriage motor for rotating the pulley 8.

Numeral 10 is a paper sensor for detecting the presence of a recording medium arranged in the vicinity of the surface of the platen 1, numeral 11 an encoder sensor mounted on the head 4, and numeral 12 a linear encoder fixedly arranged in parallel to the platen 1 and also opposed to the encoder sensor 11. Numeral 13 is a home position sensor for detecting that the head 4 is in the home position, numeral 14 is a cap which is used when restoring poor discharge including non-discharge, numeral 15 a motor which is the driving source for progressing forward and backward the cap 14 with respect to the head, and numeral 16 a cap sensor for detecting that the cap 14 is mounted on the head 4.

In the above constitution, when the recording medium is mounted on the platen 1, it is detected by the paper sensor 10 to be made in a recordable state. When the recording start button is pushed the carriage is moved, and the head 4, after being set at the home position, moves following the printing format of the recording device, and permits ink droplets to fly following the recording data from the discharge openings. The head 4 is subjected to main scanning, driven by the belt 6 with the motor 9 as the driving source. Every time when one line of main scanning is completed, the motor 2 is driven to rotate the platen 1.

For preventing clogging of the discharge openings of the head 4, the cap 14 is covered over the head 4 periodically or if necessary. This state is detected by the cap sensor 16, and recording actuation is intermitted by this detection. The restoration actuation comprises absorbing the ink within the nozzles from outside of the nozzles by an absorbing mechanism (not shown) communicated to the cap 14, thereby removing foreign matters, etc. within the nozzles. By doing so, subsequent defective recording will be cancelled.

Next, the constitution of the control system shown in FIG. 2 is to be described.

CPU 20 constitutes the main body of control, to which a group of switches 21 (arranged on the operational panel) are connected through an input and output interface (not shown), a DC servo reversing circuit 22 for driving the carriage motor 9, a stepping motor driving circuit 23 for driving the line feed motor 2, a head driver 24 for driving the recording head 4 based on the recording data, a group of various sensors 25, the encoder sensor 11 and the home position sensor 13.

In the constitution shown in FIG. 2, CPU 20 performs the following operational actuation corresponding to the operational input performed by the switch group 21 provided on the operational panel (not shown). More specifically, by referring to the input from the encoder sensor 11 and the home position sensor 13, the driving control of the carriage motor 9 is conducted through the DC servo reversing circuit 22, and also the driving control of the line feed motor 2 through the stepping motor driving circuit 23, whereby the recording data D is output to the head driver 24 and the recording head 4 is driven with the head driver 24. Also, control of other mechanisms is conducted corresponding to the inputs from another group of sensors 25.

Under such constitution, recording actuation is commenced by pushing down of the print switch among the switch group 21, and the line feed motor is driven several steps on confirmation of the presence of recording paper by the paper sensor 10, whereby the platen 1 is rotated and the recording paper set at the recording start position. Subsequently, the carriage motor 9 is driven to move the recording head 4 in a reciprocating manner, and the line feed motor 2 is driven as synchronized therewith to deliver the recording paper line by line. During such actuation, driving signals corresponding to the recording data are applied from the head driver 24 on the recording head 4 to drive the recording head 4, whereby ink is discharged as droplets through the discharge openings of the nozzles 5 to effect recording of letters, images, etc.

FIG. 3 is a schematic front view of the head 4 in FIG. 1.

As shown in FIG. 3, four discharge openings 41, 42, 43 and 44 are arranged at predetermined intervals on the same line. To the openings 41 to 44 the ink of cyan (C), magenta (M), yellow (Y) and black (BK) are sequentially supplied. At the respective ink path communicated with the discharge opening, energy generating members generating energy for discharging ink are mounted, which may comprise piezoelectric elements, etc. (not shown), and by applying predetermined voltages to the piezoelectric element, ink is discharged through the openings as droplets. To each of the openings 41 to 44 a pressure chamber in the shape of a pipe (not shown) is individually communicated, and each pressure chamber is communicated through a vinyl pipe, etc., to an ink tank containing the color ink corresponding to that opening.

In this case, as shown in FIG. 4, for the input signal, first a voltage Vrev of negative polarity is generated for a time period T1, which voltage is applied on the piezoelectric element to expand the pressure chamber. Next, a positive voltage Vop is generated for a time period T2, which is applied on the piezoelectric element to reduce the pressure chamber, thereby discharging the ink as the droplets. Further, the application voltage is gradually reduced over a time period T3, thereby effecting restoration actuation of the nozzle diameter. By setting suitably the levels of the voltages Vrev, Vop, the ink discharging amount (namely the recording dot diameter) can be varied. The minimum time interval for ink discharging is made, for example, the maximum 3 kHz of 333 μs. Full color recording can be effected by the presence of respective driving of the energy generating member provided corresponding to ink path communicated discharge openings 41 to 44, control of the ink discharging amount, etc. Also, if the recording data D is letters data, recording of letter is also possible.

However, in such ink jet recording method of the prior art, which may be suitable for full color image by driving the energy generating member of the ink path corresponding respectively to the four colors, although printing only by black is necessary for recording of letter recording, the energy generating members in the ink path of other color are to be controlled, whereby no high speed printing could be performed. For example, in the case of performing recording one letter by 12 (dot)×7 (dot), if superfluous time other than recording is disregarded, when driven at 3 kHz, about 36 letters (3000/(12×7)=36) can be recorded per second, which however cannot be said to be high speed printing, thus not satisfying the demand.

SUMMARY OF THE INVENTION

It is an object of the present invention to provide an ink jet recording method which can solve the above-noted problem of the prior art, and enables high speed monochromatic recording by use of a color head.

It is another object of the invention to provide an ink jet recording method which performs color recording and monochromatic recording while moving relatively a head equipped with nozzles corresponding respectively to 4 colors of cyan, magenta, yellow and black and a recording medium in the main scanning direction and the sub-scanning direction, wherein the main scanning speed during said monochromtic recording is made faster than during said color recording, and also, said monochromatic recording is performed by using black and black formed by mixing the three colors of cyan, magenta and yellow alternately on the recording medium.

BRIEF DESCRIPTION OF THE DRAWINGS

FIG. 3 is a front view of a nozzle unit of a head 4 shown in FIG. 1, FIG. 4 is a drive signal waveform chart for ink injection of the discharge openings of the head shown in FIG. 3.

DETAILED DESCRIPTION OF THE PREFERRED EMBODIMENT

The present invention enables high speed monochromatic recording to accomplish the above object by making the main scanning speed during monochromatic recording faster than during color recording and performing monochromatic recording by having alternately the black of single color and the black formed by mixing the three colors of cyan, magenta and yellow recorded on a recording medium.

Also, by making black and the black by mixing of three colors recorded alternately in the main scanning direction and the sub-scanning direction on the opposed recording medium relative to the minimum recording pitch, it becomes possible to further enhance recording quality of monochromatic recording.

Further, by making the ink discharging amount of the ink for three color mixing from each discharge opening, smaller than that of the single black, the recording dot diameter of two kinds of the ink can be balanced, for example made uniform to improve recording quality.

In the present invention, by making the main scanning speed in monochromatic recording faster than during color recording and performing recording by using alternately black and the black by mixing of three colors, recording is effected as if black ink were alternately being discharged from two different discharge openings, whereby high speed monochromatic recording becomes possible with the maximum driving frequency of the head being the same.

Further, by recording the single color black and the black by mixing of three colors alternately in the main scanning direction and the sub-scanning direction, arrangement of dot size can be done with good balance, and by making the ink discharging amount through each discharge opening by three color mixing smaller, the dot diameters can be balanced, for example made uniform, whereby both can contribute to improvement of recording quality.

The present invention will be described in detail below with reference to FIGS. 5 to 7.

Figure 1:
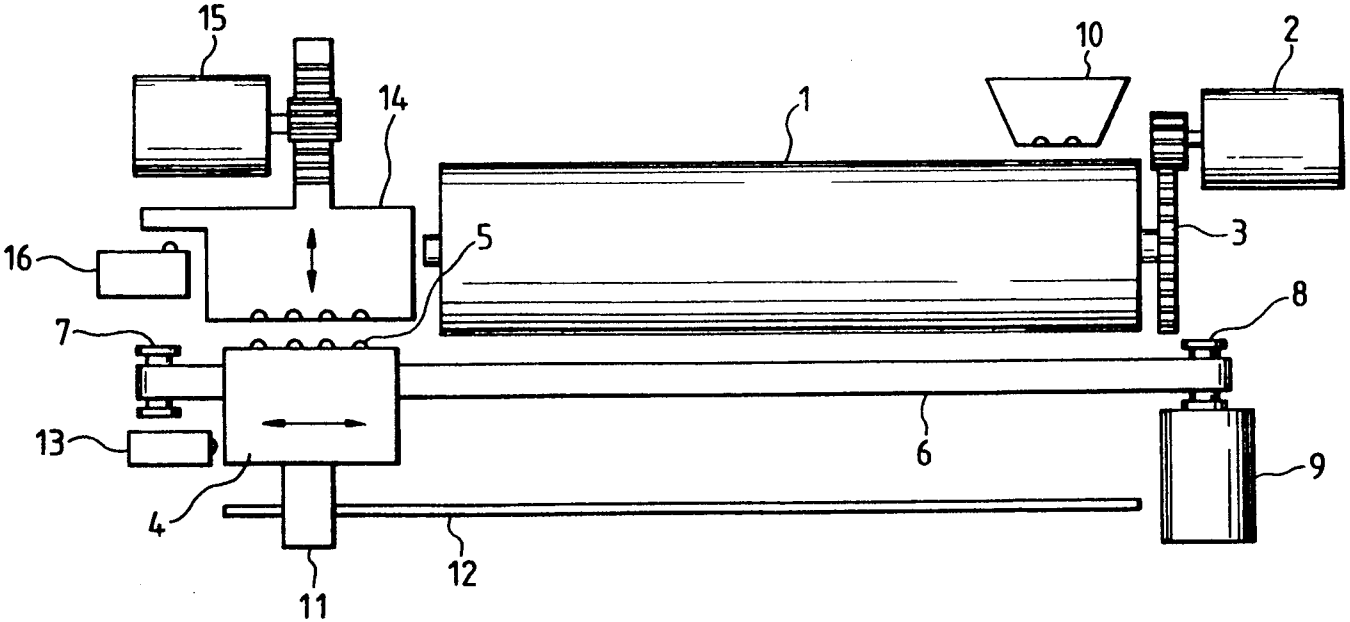
FIG. 1 PRIOR ART
FIGS. 1 and 2, are respectively, show an example of an ink jet recording apparatus and a block diagram showing its control system.
Figure 2:
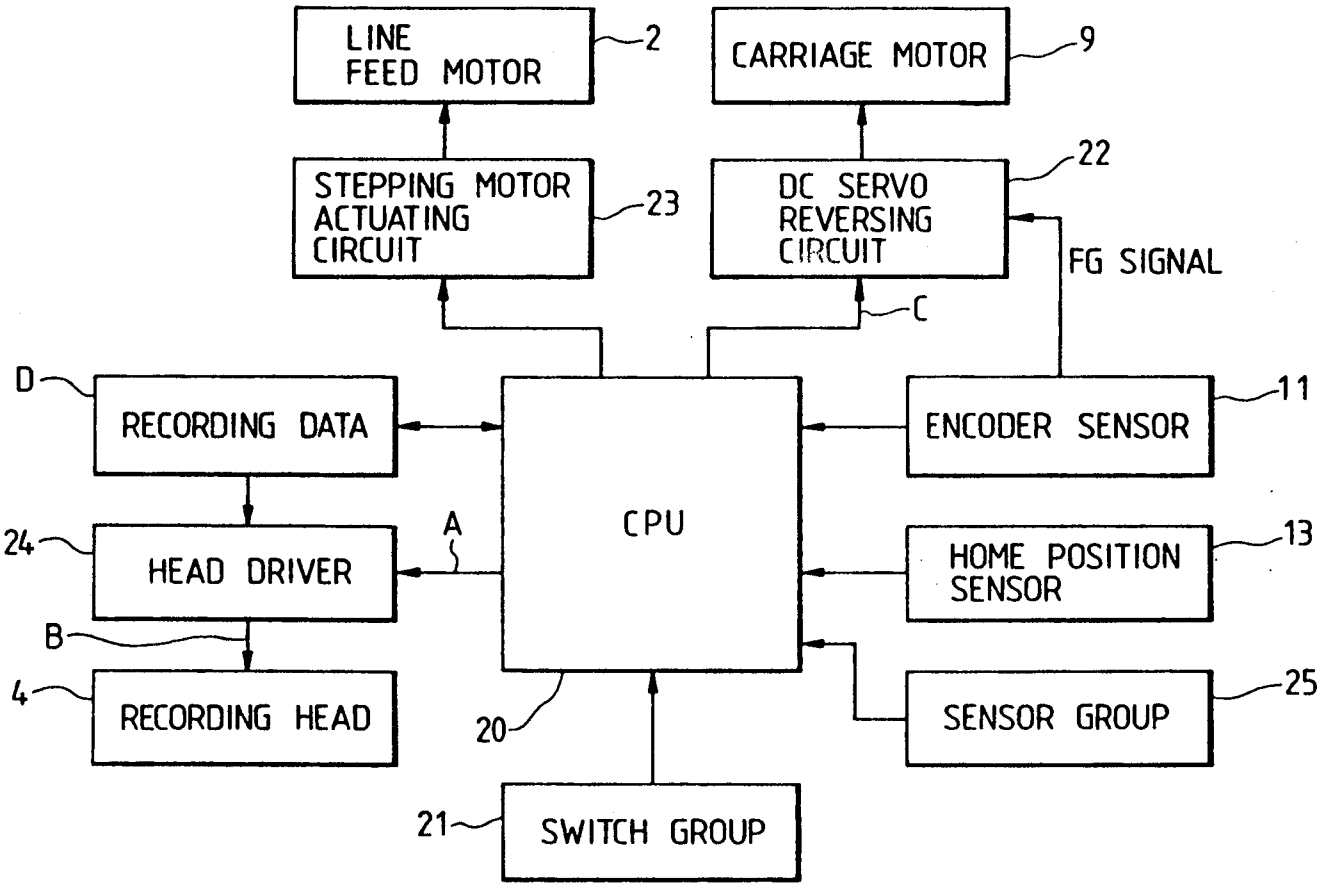
FIG. 2 PRIOR ART
Figure 5:
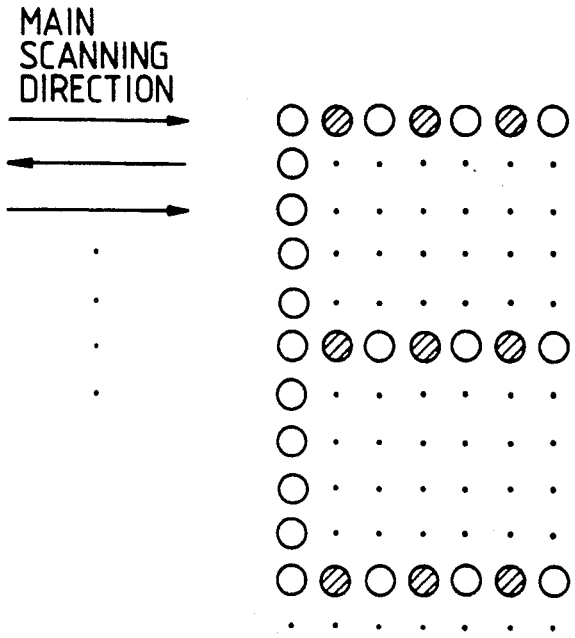
FIG. 5 is a view showing a first recording method according to the present invention.
Figure 6:
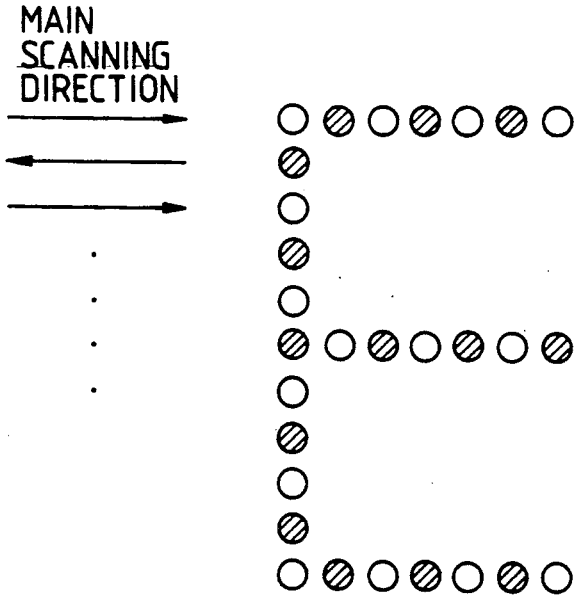
FIG. 6 is a view showing a second recording method according to the present invention.
Figure 7:
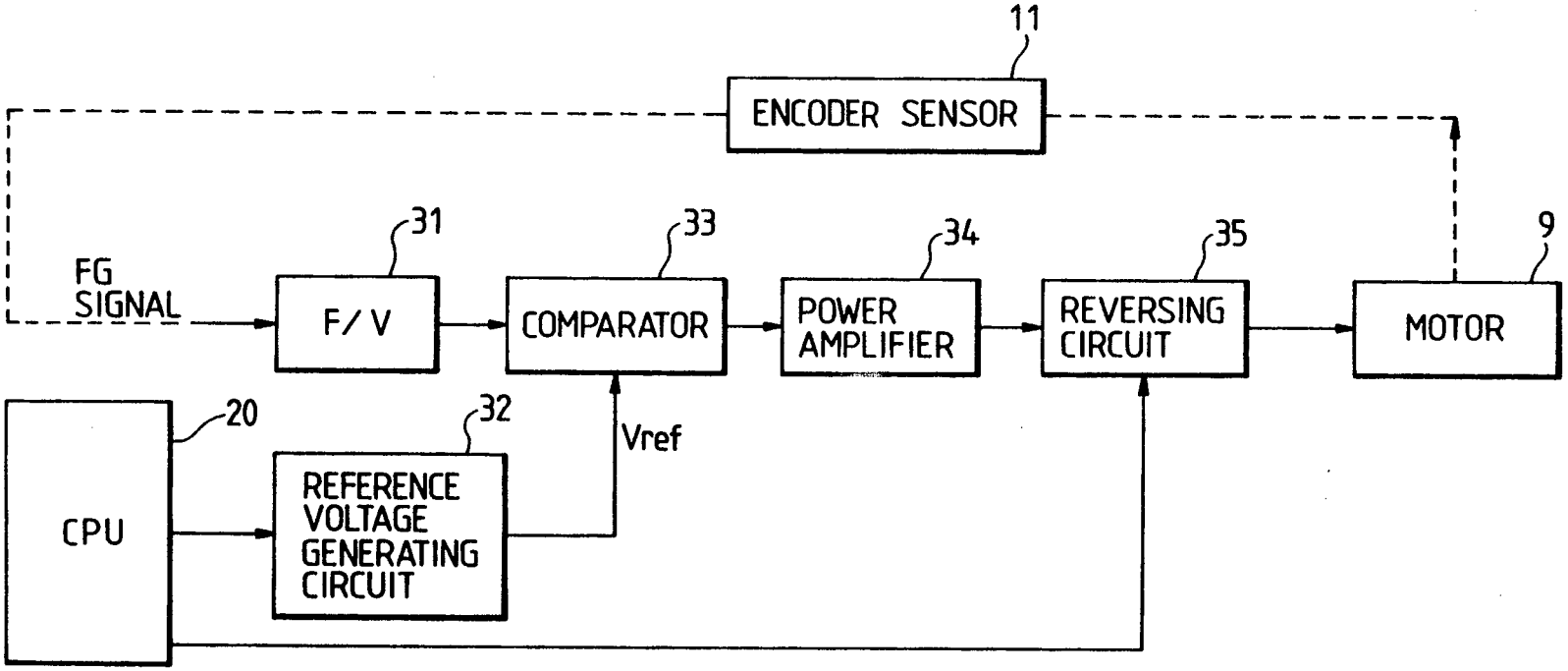
FIG. 7 is a block diagram showing a carriage motor control system necessary for realizing the present invention.

FIG. 7 is a block diagram of a carriage motor control system necessary for realizing the present invention and FIGS. 5 and 6 are views showing first and second recording methods of the present invention.

In FIG. 7, the control system includes an F/V converter 31 for frequency-voltage converting an FG signal output from an encoder sensor 11, a reference voltage generator 32 for generating two types of reference voltage Vref on the basis of a signal from a CPU 20, a comparator for comparing the reference voltage Vref and the output from the F/V converter 31, a power amplifier 34 for power-amplifying the output from the comparator 33, and a normal/reverse rotation circuit 35 for directly supplying the output from the power amplifier 34 to a carriage motor 9 or for, when an instruction is supplied from the CPU 20, supplying the output from the power amplifier 34 to the carriage motor 9 so that the carriage motor 9 is rotated in a reverse direction.

In the arrangement shown in FIG. 7, a rotational speed of the carriage motor 9, i.e. a moving speed of a head 4 is detected by the encoder sensor 11, and is fed back to the F/V converter 31. An F/V-converted signal is compared with the reference voltage Vref by the comparator 33. The reference voltage Vref is designated by the CPU 20 so that it becomes higher in a black-and-white recording mode than in a color recording mode. The comparator 33 outputs the difference between the output from the F/V converter 31 and the reference voltage Vref, and this voltage difference is power-amplified. The amplified voltage is applied to the carriage motor 9 to rotate it. The carriage motor 9 is rotated to minimize the output from the comparator 33, and its rotational speed is fed back through the encoder sensor 11, thus performing DC servo control.

When the reference voltage Vref is high, since the output from the comparator 33 is increased, the rotational speed of the carriage motor 9 is increased, and the head 4 is moved at a high speed. Therefore, in the black-and-white recording mode, the moving speed of the head 4, i.e. a main scanning speed is increased as compared to the color recording mode. Since the head 4 reciprocates along a platen 1, the normal/reverse rotation circuit 35 functions every time the head 4 reaches a main scanning moving limit, thus reversing the carriage motor.

In the following embodiment of the present invention, the reference voltage Vref in the black-and-white (monotone) recording mode is set to be double that in the color recording mode, so that the main scanning speed of the head 4 is doubled.

A recording method according to the present invention will now be described.

In FIG. 5, white circles represent dots recorded by ink drops of black ink BK, and black circles represent dots recorded in black obtained by mixing three subtractive primary colors of cyan (C), magenta (M) and yellow (Y). Small points represent non-recorded points of 7×12 dots. A character formed by white and black circles is an English letter "E", and a horizontal arrow indicates a main scanning direction.

An interval between adjacent recorded dots is about 0.15 mm, and a maximum drive frequency f of a recording head is set to be 3 kHz. Conventionally, a recording head performs main scan at 0.45 m/s, while in this embodiment, the recording head performs main scan and recording at 0.9 m/s (double or twice the conventional speed) in a black character recording mode. Odd-numbered columns in the main scanning direction are recorded in an ink color of black ink BK, and even-numbered columns are recorded in black obtained by mixing three colors C, M and Y. Thus, a conventional character recording speed is about 36 cps, while in this embodiment, the character recording speed is 71 cps or about double the conventional speed.

When the black ink BK and black obtained by mixing three colors are used, it must be determined that recording data is monotone (black-and-white) data or color tone data. For example, a switch can be arranged in a sensor group 25, and is operated in accordance with a data content. According to the operation content of the switch, the above determination can be performed by the CPU 20. Alternatively, a command can be transmitted in a data transmission mode to discriminate black-and-white data from color data. Furthermore, black-and-white or color data can be automatically discriminated by an arithmetic operation of the CPU 20 in the recording apparatus.

A second recording method of the present invention will now be described with reference to FIG. 6.

In this embodiment, in addition to the first recording method of the above embodiment, a black BK and a black obtained by mixing three colors are alternately recorded on a surface of a recording medium. In this manner, the black BK and the black obtained by mixing three colors are alternately recorded in a main scanning direction (row direction) and a subscanning direction (column direction), so that two kinds of black can be distributed to be well balanced, and recording can be made without impairing character recording quality due to a small difference between the two types of black.

Since the black obtained by mixing three colors is formed by flying ink drops at three different positions to an identical position with respect to a recorded dot of the black BK, an amount of ink becomes three times the black ink BK, and a recording dot size is increased, thus degrading character quality. Ink injection amounts from C, M, and Y nozzles are preferably controlled to be smaller than that of the black BK so that a recording dot system (or optical reflection density) of black obtained by mixing three colors is same as that of the black BK.

In the above embodiment , a head comprising four discharge openings C, M, Y and BK is used. A head unit having a plurality of such heads may be used.

In addition, the present invention can be applied to an apparatus having plural heads disposed in proximity to each other which are provided with a single or plural discharge opening for C, M, Y and BK.

Also, the so called head can be one capable of being removed from the apparatus, and can be one in which discharge openings are provided over one line relative to the member to be recorded.

The carriage motor 9 comprises a DC (direct current) motor to perform DC servo control. In place of the DC motor, a stepping motor may be used. An array of discharge openings of each color is set to be perpendicular to the above embodiment, and the main scanning direction is set to be in the rotating direction of the platen 1, so that a so-called rotary drum system may be employed.

In the above embodiment, the main scanning speed is doubled. However, the present invention is not limited to this embodiment, and a speed corresponding to an operation capacity of a mechanism can be set.

As can be apparent from the description, according to the present invention, the main scanning speed in the black-and-white recording mode is set to be higher than that in the color recording mode, and a black itself and a black obtained by mixing three colors are alternately recorded on a recording medium to perform monotone or black-and-white recording. Thus, a recording speed in a black-and-white recording mode using a color head can be increased.

Two types of black are alternately recorded in the main scanning and subscanning directions, thus improving character quality.

Ink injection amounts from the discharge openings for mixing three colors are decreased to uniform a recording dot system with balance and to improve recording quality.

I claim:

1. An ink jet recording method which selectively performs color recording and monochromatic recording, the method comprising the steps of:

providing a recording apparatus having at least one recording head with ink discharge openings for discharging ink onto a recording medium, wherein said ink discharge openings correspond respectively to black ink and a plurality of non-black inks of colors that become black when mixed, and means for moving said recording head relative to the recording medium in a main scanning direction at one of a first speed and a second speed faster than said first speed and in a sub-scanning direction, selectively performing said monochromatic recording and said color recording, wherein said monochromatic recording is performed by alternately recording on the recording medium black dots formed by said black ink and black dots formed by mixing said plurality of non-black inks and wherein said color recording is performed by selectively discharging said black and non-black inks to mix and form dots of predetermined colors on the recording medium, and moving said recording head in the main scanning direction at said first speed during said color recording and at said second speed during said monochromatic recording.

2. An ink jet recording method according to claim 1, wherein the dots of black ink and the black dots formed by mixing the plurality of non-black inks may be recorded at alternate positions of a dot matrix, in the main scanning direction and in the sub-scanning direction.

3. An ink jet recording method according to claim 1, wherein the respective amounts discharged for forming the black dots by mixing the plurality of non-black inks, are less than during color recording.

4. An ink jet recording method according to claim 1, wherein the respective amounts discharged for forming the black dots by mixing the plurality of non-black inks are less than the amount discharged for forming the dots of black ink.

5. An ink jet recording method according to claim 4, wherein the black dot formed by mixing the plurality of non-black inks and the dot of black ink are the same size.

6. An ink jet recording method according to claim 1, wherein said non-black inks are cyan, magenta and yellow.

7. An ink jet recording method which selectively performs color recording and monochromatic recording, the method comprising the steps of:

providing a recording apparatus having a recording head with ink discharge openings for discharging ink onto a recording medium, wherein said ink discharge openings correspond respectively to black ink and a plurality of non-black inks of colors that become black when mixed, and means for moving said recording head relative to the recording medium at one of a first speed and a second speed faster than said first speed, selectively performing said monochromatic recording and said color recording, wherein said monochromatic recording is performed by alternately recording on the recording medium black dots formed by said black ink and black dots formed by mixing said plurality of non-black inks and wherein said color recording is performed by selectively discharging said black and non-black inks to mix and form dots of predetermined colors on the recording medium, and moving said recording head at said first speed during said color recording and at said second speed during said monochromatic recording.

8. An ink jet recording method according to claim 7, wherein the respective amounts discharged for forming the black dots by mixing the plurality of non-black colors inks are less than during color recording.

9. An ink jet recording method according to claim 7, wherein the respective amounts discharged for forming the black dots by mixing the plurality of non-black colors inks are less than the amount discharged for forming the dots of black ink.

10. An ink jet recording method according to claim 9, wherein the black dots formed by mixing the plurality of non-black inks and the dots of black ink are the same size.

11. An ink jet recording method according to claim 7, wherein said non-black inks are cyan, magenta and yellow.

12. An ink jet recording apparatus for performing color recording and monochromatic recording, the apparatus comprising:

at least one recording head having ink discharge openings for discharging ink onto a recording medium, wherein said ink discharge openings correspond respectively to black ink and a plurality of non-black inks of colors that become black when mixed and wherein said recording head performs monochromatic recording by alternately recording on the recording medium black dots formed by said black ink and black dots formed by mixing said plurality of non-black inks and performs color recording by selectively discharging said black and non-black inks to mix and form dots of predetermined colors on the recording medium;

moving means for moving said recording head relative to the recording medium in a main scanning direction at one of a first speed and a second speed faster than said first speed and in a sub-scanning direction; and control means for controlling said moving means to move said recording head relative to the recording medium at said first speed during said color recording and at said second speed during said monochromatic recording.

13. An ink jet recording apparatus according to claim 12, wherein the dots of black ink and the black ink dots formed by mixing the plurality of non-black inks may be recorded at alternate positions of a dot matrix, in the main scanning direction and in the sub-scanning direction.

14. An ink jet recording apparatus according to claim 12, wherein the respective amounts discharged for forming the black dots by mixing the plurality of non-black inks are less than during color recording.

15. An ink jet recording apparatus according to claim 12, wherein the respective amounts discharged for forming the black dots by mixing the plurality of non-black inks are less than the amount discharged for forming the dots of black ink.

16. An ink jet recording apparatus according to claim 15, wherein the black dots formed by mixing the plurality of non-black inks and the dots of black ink are the same size.

17. An ink jet recording apparatus according to claim 12, wherein plural ink discharge openings are integrally provided on said head.

18. An ink jet recording apparatus according to claim 17, wherein one ink discharge opening is provided for each color of ink.

19. An ink jet recording apparatus according to claim 16, wherein plural ink discharge openings are provided for each color of ink.

20. An ink jet recording apparatus according to claim 12, wherein a plurality of heads are provided.

21. An ink jet recording apparatus according to claim 20, wherein one ink discharge opening is provided for each color of ink on each head.

22. An ink jet recording apparatus according to claim 20, wherein plural ink discharge openings are provided for each color of ink on each head.

23. An ink jet recording apparatus to claim 12, wherein said head is removably mounted on a main body of the apparatus.

24. An ink jet recording apparatus according to claim 12, wherein said non-black inks are cyan, magenta and yellow.

25. An ink jet recording apparatus which performs color recording and monochromatic recording, the apparatus comprising:

a recording head having ink discharge openings for discharging ink onto a recording medium, wherein said ink discharge openings correspond respectively to black ink and a plurality of non-black inks of colors that become black when mixed and wherein said recording head performs monochromatic recording by alternately recording on the recording medium black dots formed by said black ink and black dots formed by mixing said plurality of non-black inks and performs color recording by selectively discharging said black and non-black inks to mix and form dots of predetermined colors on the recording medium;

moving means for moving said recording head relative to the recording medium at one of a first speed and a second speed faster than said first speed; and control means for controlling said moving means to move said recording head relative to the recording medium at said first speed during said color recording and at said second speed during said monochromatic recording.

26. An ink jet recording apparatus according to claim 25, wherein plural ink discharge openings are integrally provided on said head.

27. An ink jet recording apparatus according to claim 26, wherein one ink discharge opening is provided for each color of ink.

28. An ink jet recording apparatus according to claim 26, wherein plural ink discharge openings are provided for each color ink.

29. An ink jet recording apparatus to claim 25, wherein a plurality of heads are provided.

30. An ink jet recording apparatus according to claim 29, wherein one ink discharge opening is provided for each color of ink on each head.

31. An ink jet recording apparatus according to claim 29, wherein plural ink discharge openings are provided for each color of ink on each head.

32. An ink jet recording apparatus according to claim 25, wherein at least one head equipped with the ink discharge openings is provided and is removably mounted on a main body of the apparatus.

33. An ink jet recording apparatus according to claim 25, wherein said head is provided with ink discharge openings extending a line length of the recording medium for each color of ink.

34. An ink jet recording apparatus according to claim 25, wherein said non-black inks are cyan, magenta and yellow.

* * * * *

UNITED STATES PATENT AND TRADEMARK OFFICE

CERTIFICATE OF CORRECTION

PATENT NO. : 5,220,342

DATED : June 15, 1993

INVENTOR(S) : JIRO MORIYAMA

It is certified that error appears in the above-identified patent and that said Letters Patent is hereby corrected as shown below:

COLUMN 1

Line 15, "used" should read --used,-- and
"in" should read --in a--.
Line 32, "a" should read --is a--.
Line 43, "a" should read --is a--.
Line 45, "a" should read --is a--.

COLUMN 3

Line 12, "letters" should read --letter-- and
"letter" should read --letters--.
Line 19, "color" should read --colors--.
Line 31, "problem" should read --problems--.
Line 48, "are" should be deleted.

COLUMN 7

Line 22, "inks," should read --inks--.
Line 65, "colors" should be deleted.

COLUMN 8

Line 1, "colors" should be deleted.
Line 37, "ink" (second occurrence) should be deleted.
Line 62, "16," should read --17,--.

COLUMN 9

Line 4, "to" should read --according to--.

UNITED STATES PATENT AND TRADEMARK OFFICE

CERTIFICATE OF CORRECTION

PATENT NO. : 5,220,342

DATED : June 15, 1993

INVENTOR(S) : JIRO MORIYAMA

It is certified that error appears in the above-identified patent and that said Letters Patent is hereby corrected as shown below:

COLUMN 10

Line 12, "to" should read --according to--.

Signed and Sealed this

Twenty-second Day of March, 1994

Bruce Lehman

*Attest:*

BRUCE LEHMAN

*Attesting Officer*

*Commissioner of Patents and Trademarks*

--